United States Patent [19]

Mezger et al.

[11] 4,250,951

[45] Feb. 17, 1981

[54] DEVICE FOR SPRAYING OF A COOLANT ON STEEL PLATES DURING CONTINUOUS CASTING

[75] Inventors: Sepp Mezger, Eningen; Werner Christner, Hohenstein-Odenwaldstetten; Hans Schrewe, Düsseldorf; Fritz-Peter Pleschiutschnigg, Dortmund; Kurt Lerch, Düsseldorf, all of Fed. Rep. of Germany

[73] Assignees: Lechler GmbH & Co. KG, Fellbach; Mannesmann AG, Düsseldorf, both of Fed. Rep. of Germany

[21] Appl. No.: 28,433

[22] Filed: Apr. 9, 1979

[30] Foreign Application Priority Data

Apr. 15, 1978 [DE] Fed. Rep. of Germany ..... 2816441

[51] Int. Cl.[3] ..... B22D 11/124

[52] U.S. Cl. ..... 164/444; 239/433; 239/565

[58] Field of Search ..... 164/444, 443, 89, 348; 239/433, 434, 557, 565

[56] References Cited

U.S. PATENT DOCUMENTS

| | | | |
|---|---|---|---|
| 1,087,086 | 2/1914 | Hand | 239/433 |
| 1,665,224 | 4/1928 | Shield | 239/434 |
| 3,659,428 | 5/1972 | Kunioka et al. | 239/434 |
| 4,019,560 | 4/1977 | Gruner et al. | 164/444 |

*Primary Examiner*—R. L. Spruill
*Assistant Examiner*—K. Y. Lin
*Attorney, Agent, or Firm*—Shlesinger, Arkwright, Garvey and Dinsmore

[57] ABSTRACT

A device for spraying a mixture of coolant and propellant onto steel plate emerging from a continuous casting mold through guide rolls comprising a mixing chamber and means separately feeding coolant and propellant thereto, a nozzle housing having at least two nozzle outlets offset in side by side and oppositely directed relationship and adapted to discharge the coolant/propellant mixture in wide dispersion and at an acute angle onto the steel plate and feed means connecting the mixing chamber with the nozzle housing and including a replaceable insert pipe extending into the mixing chamber.

5 Claims, 8 Drawing Figures

DEVICE FOR SPRAYING OF A COOLANT ON STEEL PLATES DURING CONTINUOUS CASTING

This invention relates to a device for the spraying of a coolant on steel plates as they come out of the mold during continuous casting, with spray nozzles, to which is connected a mixing chamber with separate feed for the propellant and coolant, and which nozzles engage in the area between two adjacent guide rollers of the casting plate, whereby the nozzle outlets are offset relative to each other in their side by side arrangement, are arranged in opposite directions, and are so configured that the propellant and coolant mixture impacts on the steel plate surface in wide dispersion and at an acute angle, whereby the nozzle housing is arranged between the plane of the guide roller axes and the steel plate surface.

A device of this type is known for example in German Pat. No. 24 44 613. With this type of cooling device, the coolant is applied with precise regulation, to the almost total exclusion of the Leidenfrost frostbite phenomenon, and avoids damming up of water between roller and casting surface as well as avoids the presence of excess water, without use of additional means, and uniformly distribute the coolant along the continuous casting plate.

In contrast with the known construction of German Pat. No. 24 44 613, the object of the present invention consists essentially of the following advances in the art:

1. A uniform distribution of the water/air or water/-steam or water/gas mixture is produced on the plate by uniformly propelled application of the mixture during spraying over the surface of the plate.

2. It is possible to spray into the roller shadows, i.e., the triangular area between plate surface and roller, whereby the excess remaining water and scale particles are stripped out of the roller shadow area by the blowing away action of the mixture being sprayed thereon.

3. The water throughput volume is regulable, and without infringement on the spray formation when using any particular nozzle.

In the basic disclosure of the invention, the problem is essentially resolved in that at least two nozzle outlets which are offset side by side from each other and are directed in opposite directions originate from one common nozzle housing supplied with coolant from the mixing chamber, and wherein the coolant connection of the mixing chamber is formed by an exchangeable insert pipe, which extends into the mixing chamber.

With the insert pipe according to the invention, it is possible, with the same nozzle housing or similar outlets, to select the desired volume stream relationships or proportions of coolant to propellant, without the necessity of variation of the nozzle itself. It is also possible, to provide a regulation device for propellant and coolant integral with the insert pipe, which allows the coolant-propellant relationship to be varied during the spraying, without requiring any corresponding variation of the coolant or propellant pressure.

One further essential advantage of the invention is disclosed in the common nozzle housing for the nozzle outlets. Thus it is possible to considerably shorten the passage between the breakdown of the coolant-propellant mixture into at least two streams and the nozzle outlets. Also the application of one common nozzle housing allows larger nozzle diameters, whereby the flow resistance loss is lessened and correspondingly the stream force at the nozzle outlets is increased.

The nozzle outlets in the housing furthermore can be of almost any desired geometric configuration. According to the invention, a square, rectangular, elliptical or triangular form of outlet is preferred, which is produced by the configuration of the dimensions of the passages to the outlets. A great stream depth as well as a uniform mixture by volume can be produced out of any opening, together with a uniform distribution of the coolant-propellant mixture over the plate to be cooled.

In summary it can be said that the cooling device according to the invention guarantees application of streams of precisely defined volume, and also allows the use of different liquid and gas pressure within a great range. Pressure ranges at least between 1 to 10 bars for gas/air and water can be attained. The cooling device according to the invention furthermore features certain functional capacity as well as a high level of precision in the required fluid distribution, e.g., the distribution can be symmetrical. The capacity for variation of the nozzle is greatly increased by the possibility of exchange of the insert pipe forming the coolant connection to the mixing chamber, and remarkably improves the regulation of the gas and fluid volumes applied to the plate to be cooled. The cooling device according to the invention is thus characterized by a greater range of use than is customary with known devices, and it also efficiently cools the extruded plate.

In another advantageous configuration of the invention, it is disclosed that the nozzle housing is connected detachably with the mixing chamber. This measure has a remarkable effect in relation to the fact that the spray nozzles themselves are subjected to greater wear or corrosion than the mixing chamber which lies further away from the hot cast plate. When the spray nozzles are worn, it is thus simpler to exchange the entire nozzle housing, while continuing to use the mixing chamber. Further particular features and advantages of the invention can be derived relative to an embodiment shown in the drawing and the following description.

Figure 1:
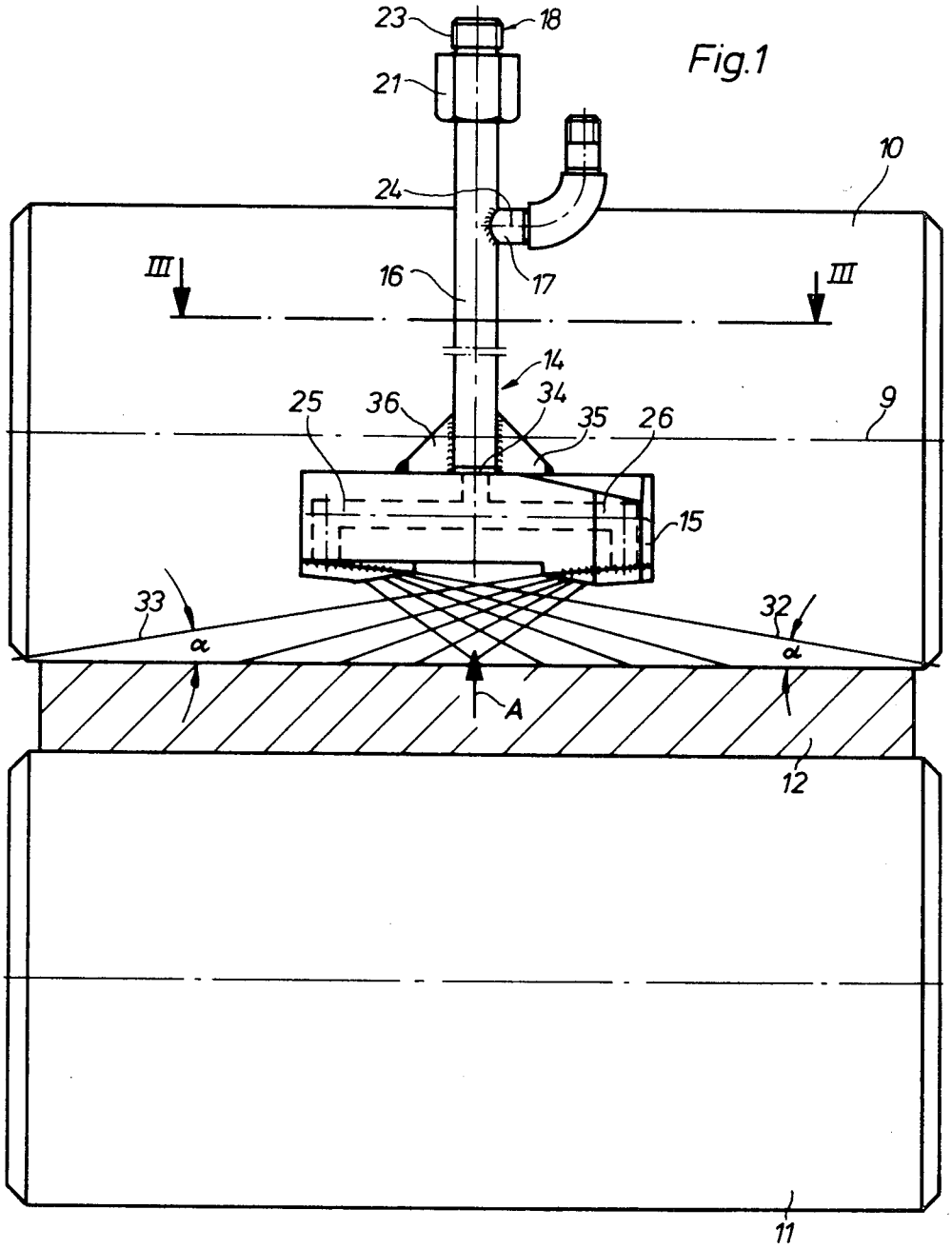
FIG. 1 is a total view of a cooling device of the invention, viewed in the direction of casting.

FIG. 1 shows two guide rollers 10, 11 for a steel plate-continuous casting assembly. The steel plate 12 is guided between guide rollers 10, 11.

A cooling device 14 is mounted between two guide rollers on one side of steel plate 12, and consists essentially of two separate assemblies, on the one hand a nozzle housing 15, and on the other hand a mixing chamber 16. A feed connection 17 for the propellant, e.g., air, opens into the mixing chamber on the side. The coolant, e.g., water, is fed to mixing chamber 16 through feed connection 18.

Figure 4:
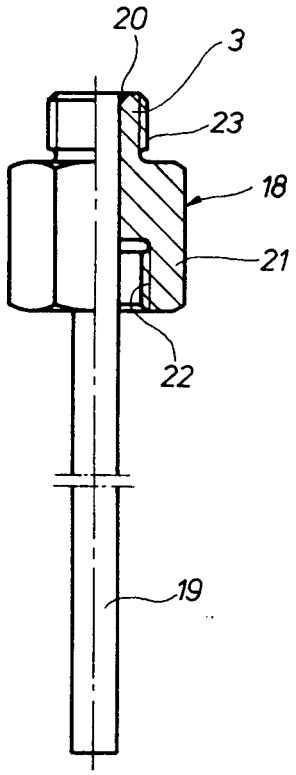
FIG. 4 shows the coolant connection configured as insert pipe in a separate representation.

FIG. 4 shows the coolant fluid connection 18 configured essentially as insert pipe 19, which projects coaxially into the tubular mixing chamber 16. At the top end of insert pipe 19, at 20, is spot welded a retaining or clamping nut 21, with inside threading 23, which is provided to hold a coolant fluid line, e.g., in the customary manner by means of a screw cap.

The coolant liquid, e.g., water, is therefore conducted from 23 into insert pipe 19 and from there into mixing chamber 16. The volume flow of the coolant fluid is herein precisely determined by the inside diameter of the insert pipe 19 which is being used. If insert pipe 19 is replaced by another larger or smaller diameter insert pipe, it extends is easily possible to vary the volume of the coolant water, independent of the volume flow of the air coming into mixture chamber 15 at 17, and independent of the dimensions of nozzle housing 15. Since insert pipe 19 is easily exchangeable, different volume flow relationship of coolant fluid/propellant can be selected very simply, without having to undertake variation or change of nozzle housing 15 itself. Also, the pressure relationship of the coolant fluid on the one hand and the propellant on the other hand do not need to be changed.

Insert pipe 19 is at least 48 mm beyond the middle axis 24 of propellant feed opening 17 to its distal end. This length is necessary to allow it the capacity to vary the pressures of coolant fluid and propellant, to attain one more possibility of regulation of the propellant/coolant fluid mixture. On the basis of the relatively large diameter of mixing chamber 16, the friction losses of the mixture along the passage to the nozzle outlets are maintained at a low level, which advantageously leads to an increase of the stream force of the spray streams coming out of the nozzle outlets.

It is advantageous that the fluid-propellant-mixture stream is not divided until within nozzle housing 15, and then is divided into at least two partial streams. This division into streams is indicated by two broken lines 25, 26 in FIG. 1.

Figure 2:
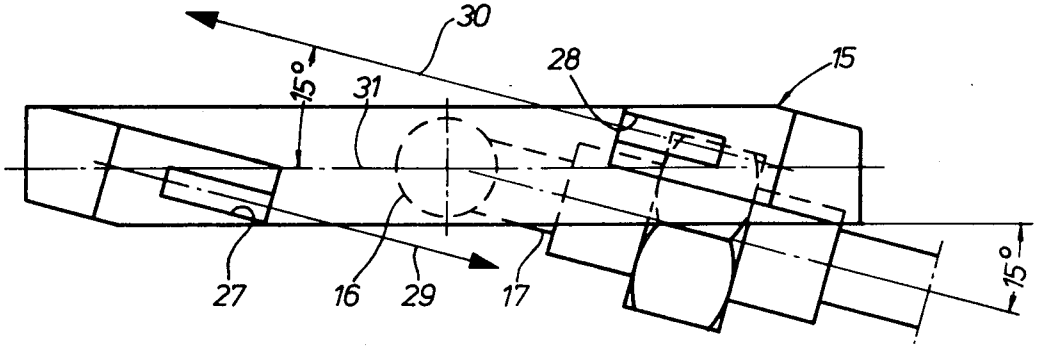
FIG. 2 shows the cooling device as in FIG. 1 but viewed from the direction of arrow A, whereby the directions of spray 29, 30 run parallel to the roller axis 9 in FIG. 1.

The arrangement and configuration of nozzle openings 27, 28 of nozzle housing 15 is particularly clear in FIG. 2. The spray direction is indicated by arrows 29, 30. By rotation of the spray directions 29, 30 in relation to longitudinal axis 31 of nozzle housing 15 around for example about 15 degrees, it is assured that the spray streams coming out of nozzle outlets 27, 28 do not obstruct each other.

Figure 3:
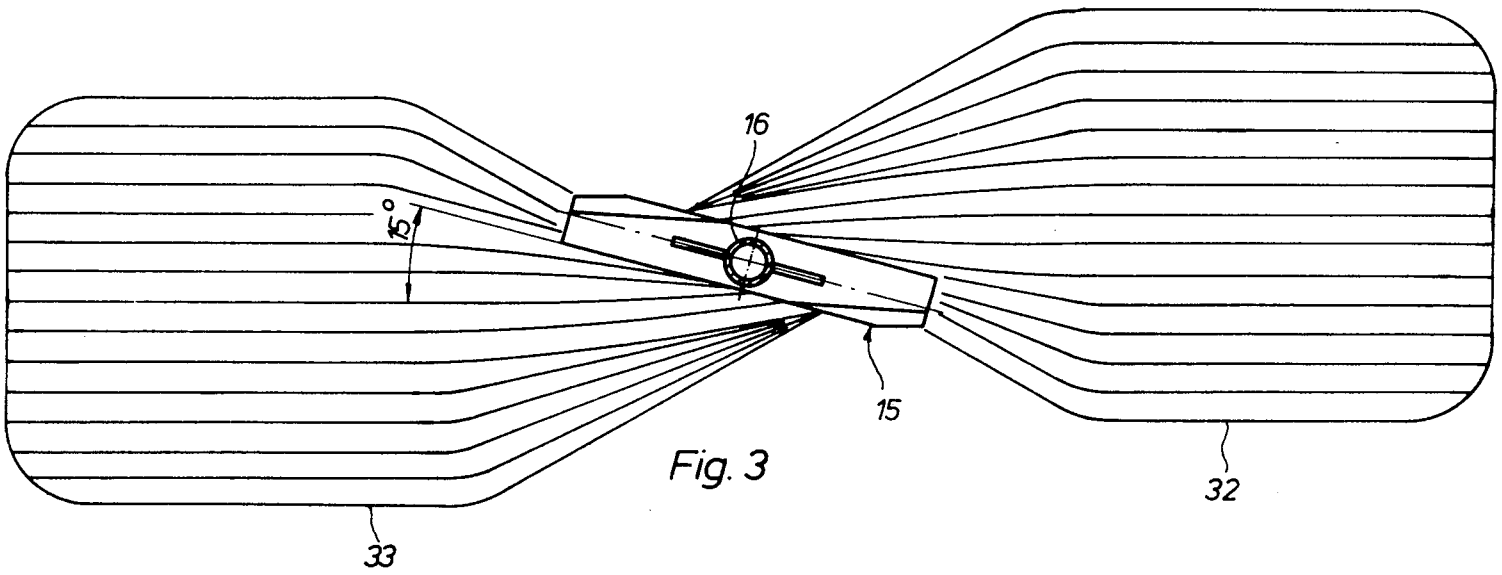
FIG. 3 shows a cross section along line III—III of FIG. 1, with the guide rollers and cast steel plate deleted.

The form of the spray that is obtained thereby is visible in the FIG. 3 frontal view of nozzle housing 15. The spray form 32 herein corresponds to a normal or perpendicular projection of the spray stream coming out of nozzle 28. The surface of plate 12 which is impacted is indicated by the spray forms 32, 33 together.

Figure 8:
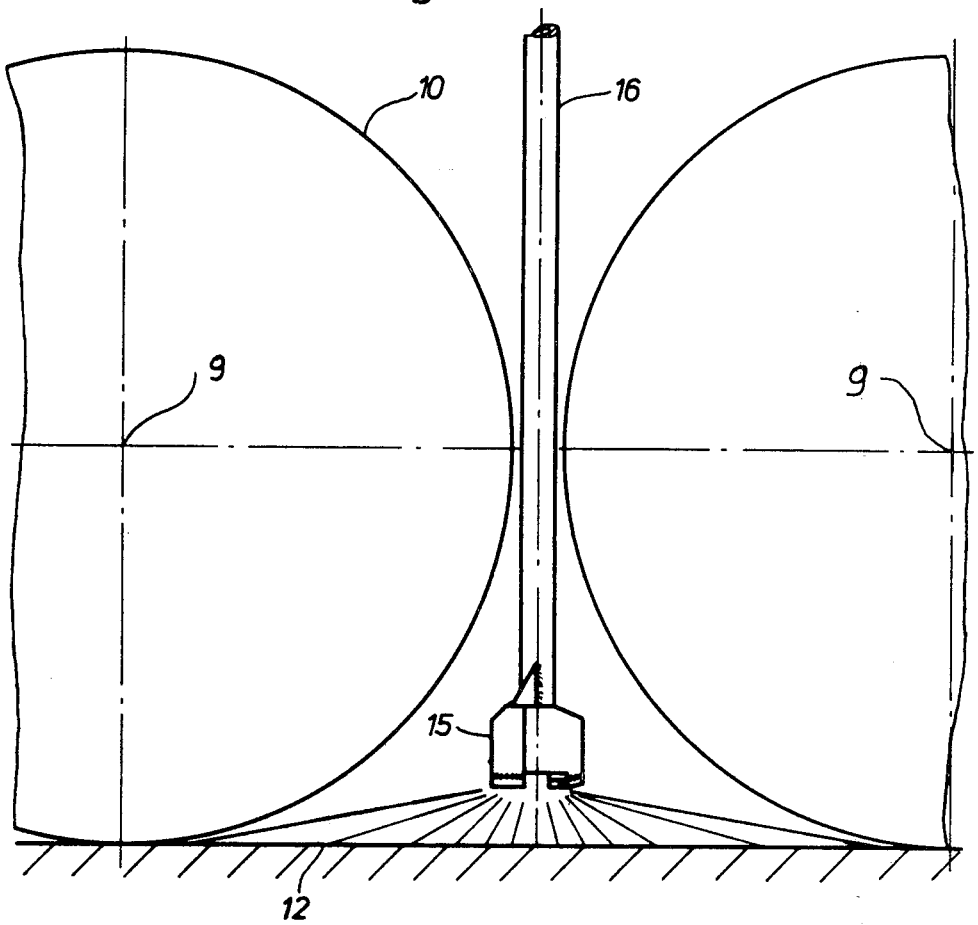
FIG. 8 shows the representation of FIG. 7 from the direction C.

FIGS. 1 and 3 clarify that plate 12 is impacted by spray streams 32, 33 on its entire breadth. FIG. 8 shows that the plate is also sprayed and cooled in the area of the shadows of the rollers, in other words, adjacent to the contact surfaces between roller and plate.

FIG. 1 shows the spray form 32, 33 pointed in a 90° different direction from that of FIG. 3, and therefore shows that the propellant-coolant-mixture impacts on the surface of the plate at an acute $\alpha$ angle. The $\alpha$ angle is of 2–10 degrees, preferably about 5 degrees.

The connection 34 of nozzle housing 15 with mixing chamber 16 is a screw connection, to facilitate easy change of the nozzle housing, e.g. if it is worn. FIG. 2 shows nozzle housing 15 so adjusted on propellant feed line 17 that spray directions 29, 30 out of the nozzle outlets are exactly parallel to propellant feed line 17. In this setting, nozzle housing 15 is fixed in relation to mixing chamber 16 by means of welded-on ribs 35, 36. Since nozzle housing 15 projects far into the narrow chamber between two guide rollers of the continuous casting assembly, lying one over the other, and cannot be viewed from the outside, nozzle outlets 27, 28 are to be set exactly from the outside by control of the setting of propellant feed line 17.

For further control and regulation of the required position setting of the nozzle housing and for simplification of assembly, the device can be mounted tightly on a mounting plate 37, whereby the nozzle housing is adjusted and, the stream direction is automatically controlled with an accompanying control device.

The cooling device 15, 16 in FIG. 1 is greatly enlarged in relation to guide rollers 10, 11 and plate 12, in order to show the individual features of the cooling device.

Figure 7:
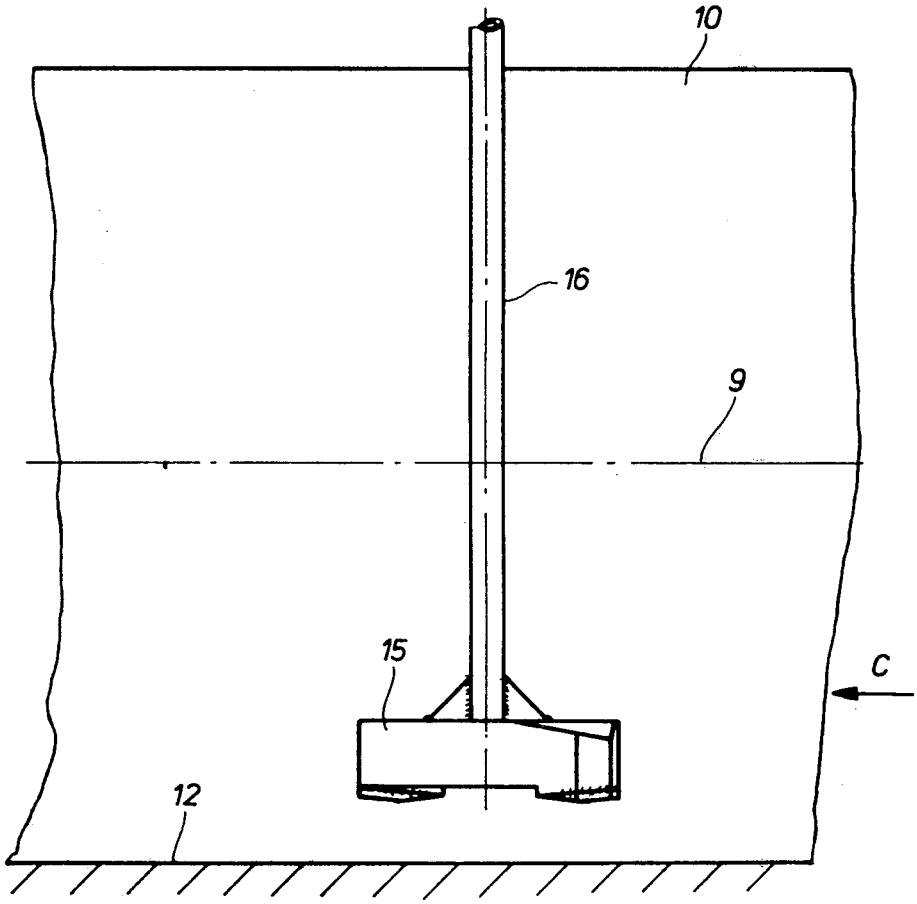
FIG. 7 shows the structure assembly in true size relations corresponding to the representation of FIG. 1.

In practice of course the cooling device 15, 16 is essentially smaller in relation to the shown parts of the continuous assembly. The true size relationships are shown more approximately in FIGS. 7 and 8.

Figure 5:
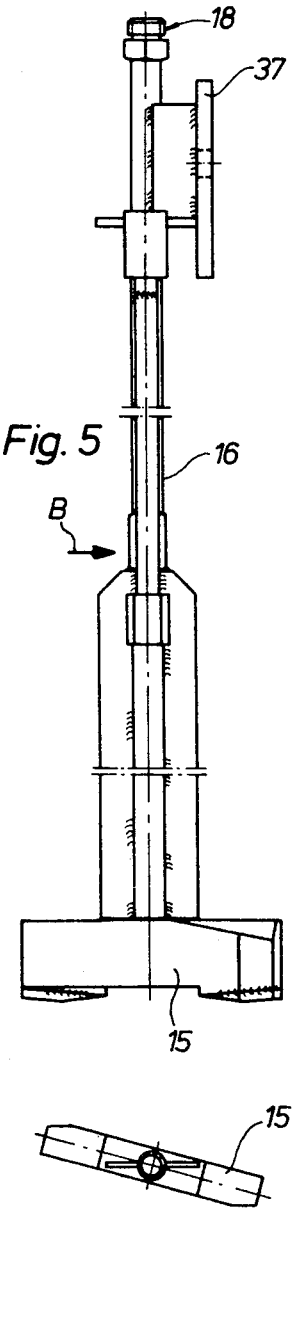
FIG. 5 shows an embodiment of a cooling device according to the invention, as in FIG. 1, including a mounting.
Figure 6:
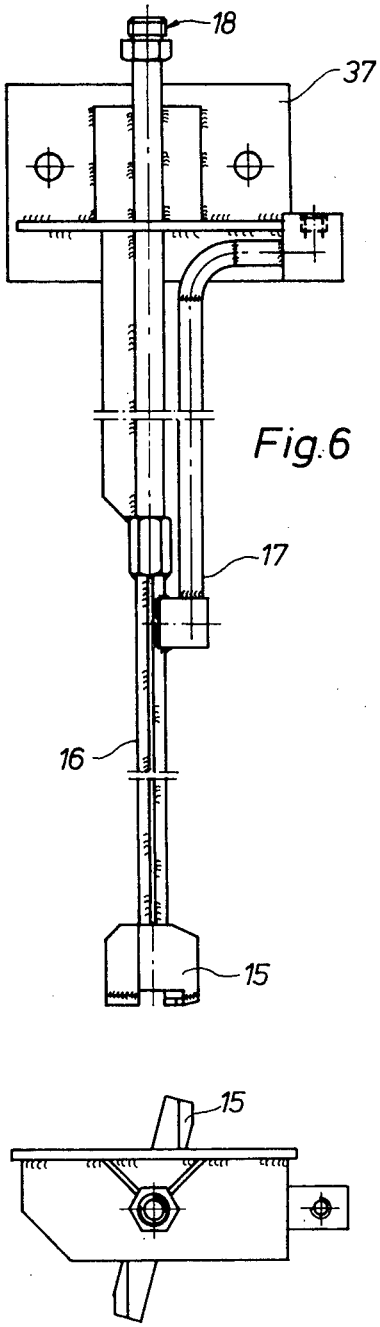
FIG. 6 shows FIG. 5 as viewed in the direction of arrow B.

The device according to the invention is not limited to the embodiment of FIG. 1 and FIGS. 5 and 8, wherein the propellant and coolant feed lines and the mixing chamber are perpendicular to the roller axis.

Other embodiments can be so configured that these feed lines are along the side and parallel to the guide roller axes 9 in the area between guide roller axis 9 and plate surface 12.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A device for spraying a coolant-propellant onto steel plates emerging from a continuous casting mold and supported by two pairs of support rolls, comprising a nozzle housing positioned between said pairs of support rolls on one side of the steel plate, a mixing chamber detachably connected to said nozzle housing and having separate inlet passages for a coolant and a propellant and an outlet passage in fluid communication with said nozzle housing, said nozzle housing having a pair of fluid discharge nozzles, said nozzles being arranged in offset side-by-side relationship and oppositely directed and so configured that the coolant-propellant mixture impacts on the surface of the steel plate in wide dispersion and at an acute angle thereto, said nozzle housing further including guiding means for dividing the incoming coolant-propellant mixture into separate streams and for directing said streams to said nozzles, said mixing chamber comprising an elongated tubular housing connected to said nozzle housing and having one of said inlet passages entering radially therein, and the other of said inlet passages comprising a replaceable insert pipe coaxially positioned within said tubular housing and having a fluid tight connection with said tubular housing at one end and opening into said tubular housing at the distal end therefor wherein said insert pipe extends at least about 48 mm beyond said inlet passage toward said nozzle housing.

2. A device as in claim 1 and wherein the outlet of said nozzles are square.

3. A device as in claim 1 and wherein said nozzles are positioned such that the discharge from said nozzles is at an angle of about 15° with the longitudinal axis of said nozzle housing and the longitudinal axis of said one of said inlet passages at the connection is substantially parallel to the directions of said nozzles.

4. A device as in claim 3 and including means for mounting said device in a fixed position relative to said rolls.

5. A device as in claim 3 and wherein said nozzles are positioned such that the discharge from said nozzles impringes on the steel plate at an angle of 2°–10°.

* * * * *